US010321759B2

(12) United States Patent
Janzen

(10) Patent No.: US 10,321,759 B2
(45) Date of Patent: Jun. 18, 2019

(54) GUIDE DEVICE FOR GUIDING A FURNITURE PULL-OUT THAT IS MOVEABLE RELATIVE TO A FURNITURE BODY

(71) Applicant: Grass GmbH, Höchst (AT)

(72) Inventor: Jörg Janzen, Lustenau (AT)

(73) Assignee: Grass GmbH, Höchst (AT)

( * ) Notice: Subject to any disclaimer, the term of this patent is extended or adjusted under 35 U.S.C. 154(b) by 2 days.

(21) Appl. No.: 15/255,642

(22) Filed: Sep. 2, 2016

(65) Prior Publication Data

US 2017/0065082 A1 Mar. 9, 2017

(30) Foreign Application Priority Data

Sep. 4, 2015 (DE) ..... 20 2015 006 278

(51) Int. Cl.

| | |
|---|---|
| ***A47B 88/447*** | (2017.01) |
| ***A47B 88/40*** | (2017.01) |
| ***A47B 88/407*** | (2017.01) |
| ***A47B 88/43*** | (2017.01) |
| ***A47B 88/493*** | (2017.01) |

(52) U.S. Cl.

CPC ..... *A47B 88/447* (2017.01); *A47B 88/40* (2017.01); *A47B 88/407* (2017.01); *A47B 88/43* (2017.01); *A47B 88/493* (2017.01); *A47B 2210/0091* (2013.01); *A47B 2210/0094* (2013.01)

(58) Field of Classification Search

CPC ... A47B 88/40; A47B 88/0407; A47B 88/044; A47B 88/10; A47B 2210/0091; A47B 2210/0094

USPC ..... 312/334.1

See application file for complete search history.

(56) References Cited

U.S. PATENT DOCUMENTS

| | | | | |
|---|---|---|---|---|
| 9,386,850 | B2 * | 7/2016 | Dubach | A47B 88/047 |
| 2002/0033658 | A1 * | 3/2002 | Salice | E05F 5/027 312/334.14 |
| 2008/0191592 | A1 * | 8/2008 | Dubach | E05B 65/46 312/319.1 |

(Continued)

FOREIGN PATENT DOCUMENTS

| | | | |
|---|---|---|---|
| DE | 102010036741 | A1 | 2/2011 |
| DE | 202013011559 | U1 | 3/2015 |

*Primary Examiner* — Daniel J Troy
*Assistant Examiner* — Timothy M Ayres
(74) *Attorney, Agent, or Firm* — Edell, Shapiro & Finnan, LLC

(57) ABSTRACT

A guide device for guiding a furniture pull-out moveable relative to a furniture body comprises: at least one guide unit having a body rail that can be fastened to the furniture body and at least one running rail that is displaceably mounted relative to the body rail; and a functional device comprising at least a first functional element that can be fastened to the moveable furniture pull-out, at least one body-sided second functional element, both functional elements being guided on one another during the retraction movement and/or the extension movement of the furniture pull-out, and a catch device having a bearing mechanism by which the first or second functional element can be moveably hung and having a control surface formed on the first and/or second functional element by which the moveable first functional element can be captured to subsequently guide on the second functional element.

12 Claims, 8 Drawing Sheets

(56) References Cited

U.S. PATENT DOCUMENTS

| | | | | |
|---|---|---|---|---|
| 2008/0265732 | A1* | 10/2008 | Weber | A47B 88/40<br>312/334.1 |
| 2014/0294328 | A1* | 10/2014 | Pecar | A47B 88/04<br>384/20 |
| 2016/0319582 | A1* | 11/2016 | Grabher | E05F 5/003 |
| 2017/0067277 | A1* | 3/2017 | Janzen | E05F 5/003 |

* cited by examiner

GUIDE DEVICE FOR GUIDING A FURNITURE PULL-OUT THAT IS MOVEABLE RELATIVE TO A FURNITURE BODY

CROSS REFERENCE TO RELATED APPLICATIONS

This application claims foreign priority under 35 U.S.C. § 119(a)-(d) to German Application No. 20 2015 006 278.4 filed on Sep. 4, 2015, the entire contents of which are hereby incorporated by reference.

FIELD OF THE INVENTION

The invention relates to a guide device for guiding a furniture pull-out, which can be moved in relation to a furniture body, said guide device comprising at least one guide unit, which has a body rail, which can be fastened to the furniture body, and at least one running rail, which is displaceably mounted relative to the body rail, and comprising a functional device, which comprises at least a first functional element, which can be fastened to the moveable furniture pull-out, and at least one body-sided second functional element, both functional elements being guided on one another during the retraction movement and/or the extension movement of the furniture pull-out.

BACKGROUND

Guide devices for guiding a furniture pull-out, which can be moved in relation to a furniture body, for example, pull-out guides for drawers, have already been known for a long time. Furthermore, it is known to equip such guide devices with functional devices, for example, with a self-retracting device, by means of which the moveable piece of furniture, in particular, the drawer, after a certain closing travel of the drawer, retracts automatically or in a power-assisted manner into the closed position.

In addition, it is known to provide guide devices with functional devices in the form of a damping device, by which it is possible to damp the retraction and/or extension movement of the moveable piece of furniture into the closing and/or opening position. Furthermore, it is known to provide adjustment devices, with which the position of the moveable piece of furniture with respect to the guide device can be changed. Such adjustment devices include, in particular, side, depth, height and/or tilt adjustment devices.

Usually several of the aforementioned functional devices are combined with each other. In this case the task of keeping the functional devices functionally effective during the side, depth and/or height adjustment of the moveable piece of furniture with respect to the guide device is often a problem, if said functional devices consist of components, which are moved on the furniture pull-out and, therefore, are moved with it at the same time, and stationary components, since the moveable piece of furniture will jump off the converging track of the components as a result of the adjustment.

SUMMARY

Therefore, the object of the present invention is to provide a guide device of the type, described in the introductory part of the specification, in such a way that the functional devices, which are arranged on the guide device, are reliably effective, even in the event that the position of the associated moveable piece of furniture is adjusted.

The guide device of the invention is characterized by the feature that it has a catch device, which has a bearing mechanism, by means of which the first or second functional element can be moveably hung, and a control surface, which is formed on the first and/or second functional element and by means of which the moveable first functional element can be captured in order to subsequently guide on the second functional element. As a result, the catch device makes it possible to guarantee that the functional device is functionally effective, even if the moveable piece of furniture is adjusted in its position, for example, in relation to the guide device, for example, by carrying out a side adjustment and/or a tilt adjustment of the moveable piece of furniture with respect to the guide device. Thus, the catch device makes sure that the component of the functional device that is disposed on the moveable piece of furniture comes into contact with the component, which is disposed on the guide device, in such a way that the functional device is functionally effective.

In a further development of the invention the pull-out-sided first functional element can be suspended from the furniture pull-out by means of the bearing mechanism in a manner allowing movement relative to the furniture pull-out, and the body-sided second functional element can be fastened stationarily relative to the furniture body via a mounting mechanism. Therefore, it is useful for one of the functional elements to be hung rigidly and the other to be hung moveably. Preferably the pull-out-sided first functional element is hung moveably, while the body-sided second functional element is fastened rigidly. As an alternative, however, it is also conceivable to fasten the pull-out-sided first functional element rigidly to the furniture pull-out and to fasten the body-sided second functional element moveably to the furniture body.

In a particularly preferred manner the control surface is formed on the body-sided second functional element. Therefore, the second body-sided functional element can provide a constraining guide for the pull-out-sided first functional element.

It is possible that the control surface has an inclined section that extends at an angle in relation to the direction of movement of the furniture pull-out. This arrangement makes it easier to move the pull-out-sided first functional element, which is moved at the same time that the furniture pull-out is moved, into the constraining guide of the second functional element.

It is particularly preferred that the second functional element has a control element, which is designed, in particular, in the manner of a web having a bottom side, on which the control surface is formed. It is particularly preferred that the inclined section of the control surface is located on the control element, and that preferably the second functional element has a check surface that is located opposite the control surface and that forms together with the control surface a kind of guide channel in order to guide the pull-out-sided first guide element. The check surface may also have an inclined section that forms together with the inclined section of the control surface a kind of retraction funnel.

In a further development of the invention the body-sided second functional element has a mounting interface for fastening, in particular, without a tool to the furniture body or to a mounting angle bracket, which can be fastened to the furniture body, or to a mounting section of the body rail.

For a further development of the invention the second functional element is designed as a flat body, in particular, in the manner of a plate.

It is possible that the body-sided second functional element has at least one fastening interface for fastening accessory parts thereto. Then at least one accessory part can be fastened in a fast and easy way to the body-sided second functional element via the at least one fastening interface. It is expedient for the accessory carrier to have a plurality of fastening interfaces, so that it is possible to fasten a plurality of accessory parts to said accessory carrier. If there is a plurality of fastening interfaces, then it is possible to populate all of the fastening interfaces with accessory parts or, depending on the specific requirements, only the respective fastening interface that is required for the associated accessory part.

In a further development of the invention the pull-out-sided first functional element has a base section, which can be rigidly fastened to the furniture pull-out, and a movement section, which is moveably hung in relation to the base section, where in this case the movement section can be moved between a starting position and functional positions, which are, in particular, farther away from the base section. In principle, the movement section can occupy any functional position between the starting position and an end position, which is defined by the maximum stroke between the base section and the movement section.

It is possible that the bearing mechanism have at least one spring element having a spring force that acts on the movement section in the direction of the starting position. It is expedient for the movement section to have a guide section, which is assigned to the control surface and which is guided on the control surface.

In a further development of the invention the bearing mechanism is designed to hang the movement section in a manner allowing a swiveling motion in relation to the base section.

In a particularly preferred manner the bearing mechanism has a hinge that is effective between the base section and the movement section.

It is possible that the bearing mechanism is designed for a linearly moveable suspension of the movement section in relation to the base section.

In a further development of the invention the functional device is designed as a damping device in order to damp the opening movement of the moveable piece of furniture. Preferably in this case a clamping roller is provided on one of the functional elements, in particular, on the first functional element, and a clamping wedge, which interacts with the clamping roller, is provided on the other one of the functional elements, in particular, on the second functional element. The result of this arrangement is a kind of mechanical brake, which checks the outward extension movement of the furniture pull-out into the open position. It goes without saying that it is also possible to employ the functional devices in a different way. For example, the damping device could also be used to damp the closing movement of the furniture pull-out. Furthermore, it is possible to design the functional device as a self-retracting device.

BRIEF DESCRIPTION OF THE DRAWINGS

Preferred exemplary embodiments of the invention are shown in the drawings and are explained in greater detail below. The drawings show in.

DETAILED DESCRIPTION

Figure 1:
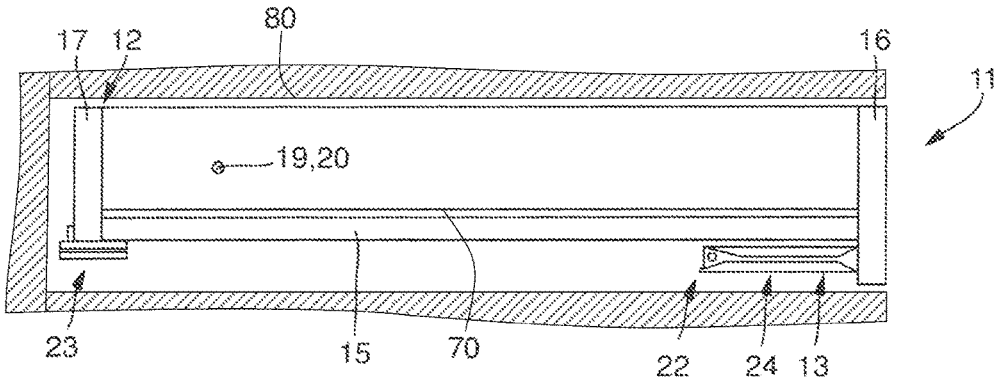
FIG. 1 a diagrammatic representation of a first exemplary embodiment of the inventive guide device with a first and second functional element of the functional device.

FIGS. 1 to 13 show a first exemplary embodiment of the guide device 11 according to the invention. In this case the guide device 11, which is shown and described only for illustrative purposes, is used to guide a furniture pull-out in the form of a drawer that can be moved in relation to a furniture body.

The drawer is displaceably mounted in relation to a furniture body 80 (depicted in FIG. 1) by means of the guide device 11. The guide device 11 comprises a plurality of guide units 13, of which two guide units 13 are assigned to the side edges of the drawer that are opposite each other. In the drawing a single guide unit 13 is shown only in schematic form, but the other guide unit, which is assigned to the opposite side edge of the drawer, is constructed in the same way.

Each of the guide units 13 has a body rail 14, which can be configured, for example, as a bent-over sheet metal component. The body rail 14 is fastened via a suitable fastener to an associated side wall of a drawer holder, which is designed in the furniture body, in such a way that said body rail is fixed in position. A central rail (not depicted) is displaceably mounted on the body rail 14, and on this central rail in turn a pull-out rail 70 (depicted in FIG. 1) is displaceably guided by a bearing mechanism. The pull-out rail is assigned to the drawer and extends below the drawer bottom 15 in the depth direction. The combination of body rail 14, central rail and pull-out rail is called full extension. However, it is also conceivable to use the guide units 13 without the central rail.

Figure 2:
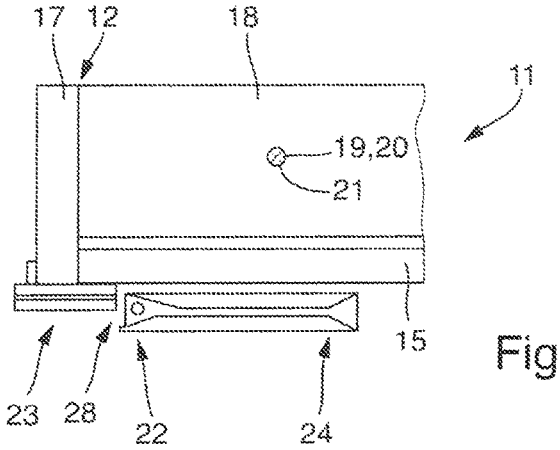
FIG. 2 an exploded representation of FIG. 1, where in this case the pull-out-sided first functional element is just about to enter into engagement with the body-sided second functional element of the functional device.
Figure 3:
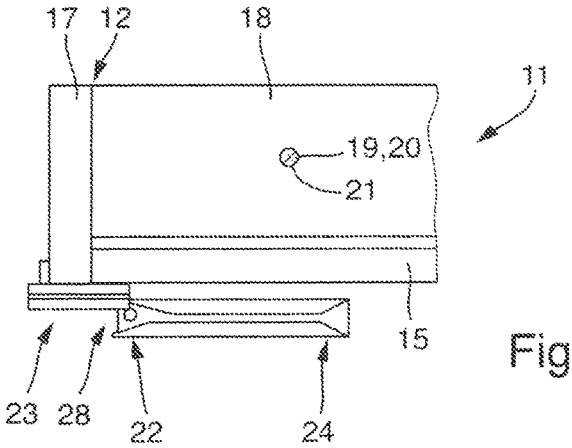
FIG. 3 a representation of the guide device from FIG. 2, with the pull-out-sided first functional element being retracted into the body-sided second functional element.

As shown, in particular, in FIG. 1, the drawer comprises not only the drawer bottom 15, but also a drawer front in the form of a front panel 16 and a drawer rear wall 17. Between the front panel 16 and the drawer rear wall 17 there extend two drawer side parts 18, which are opposite each other, and each of these drawer side parts extends in the pull-out direction of the drawer. In FIGS. 1 to 3 only one drawer side part 18 is shown. The drawer side part 18 can be designed as a side frame or as a side wall. In the illustrated example the drawer side part 18 is designed as a side fame, in which the adjustment devices 19 for adjusting the position of the drawer in relation to the guide device 11 are received.

As shown in schematic form in FIG. 1, the adjustment devices 19 comprise a height and/or tilt adjustment unit 20, which can be operated by the user via an actuating element 21, which may be found in the side frame, in order to adjust the tilt of the drawer in relation to the guide unit 13. The tilt adjustment of the drawer is carried out, in particular, with the objective of achieving at the front panel 16 in the retracted state of the drawer a visually uniform joint appearance in relation to the adjacent furniture body.

Furthermore, the guide device 11 comprises a functional device 22, which has at least a first functional element 23, which can be fastened to the drawer, and at least one body-sided second functional element 24, where both first and second functional elements are guided on one another during the inward retraction and/or outward extension movement of the furniture pull-out.

In the case of the example the functional device 22 is designed as a damping device for damping the opening movement of the drawer. As shown, in particular, in FIGS. 8 to 11, a clamping roller 25 is located on one of the functional elements 23, 24, expediently on the pull-out-sided first functional element 23, and a clamping wedge 26, which interacts with the clamping roller 25, is located on the other one of the functional elements 23, 24, preferably on the body-sided second functional element 24.

The clamping roller 25 and the clamping wedge 26 form a mechanical damping device in the manner of a brake. In the course of moving inwards, the clamping roller 25 is wedged at the clamping wedge 26 as a result of the tapering clamping gap 27. This arrangement makes sure that the outward extension movement of the drawer into the opening position is slowed down and, as a result, is damped.

Hence, in order to guarantee the function of the functional device 22, which is designed as a damping device, there is the requirement that the clamping roller 25 must come into engagement with the clamping wedge 26. Therefore, it is necessary that the pull-out-sided first functional element 23, which is moved at the same time that the drawer moves, comes into engagement with the body-sided second functional element 24 in such a way that the clamping roller 25 and the clamping wedge 26 are effective.

Therefore, the functional device 22 has a catch device 28, which has a bearing mechanism, by means of which the first or second functional element 23, 24 can be hung in a manner allowing movement, and has a control surface 29, which is formed on the first and/or second functional element 23, 24, and this control surface is used to capture the moveable first functional element 23, in order to subsequently guide the second functional element 24.

Figure 13:
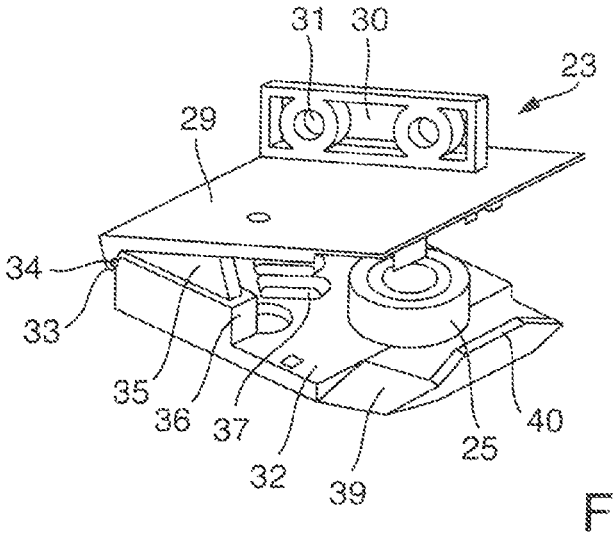
FIG. 13 a perspective representation of the pull-out-sided first functional element of the functional device, shown in FIGS. 1 to 12, and FIG. 14 a second exemplary embodiment of the inventive guide device with a second embodiment of the pull-out-sided first functional element.

In particular, FIG. 13 shows a first embodiment of the pull-out-sided first functional element 23. The first functional element 23 is suspended from the drawer by a bearing mechanism in a manner allowing movement in relation to the drawer. For this purpose the first functional element 23 has a plate-like base section 29 having a top side, from which a particularly cube-shaped mounting web 30 projects upwards. The mounting web 30 has, in particular, two mounting openings 31, in order to pass through a suitable fastener, for example, fastening screws, as a result of which the base section and, thus, the first functional element 23 can be fastened to the drawer.

As shown, in particular, in FIGS. 1 to 3, the first functional element 23 is assigned to the drawer rear wall 17, with the mounting web 30 adjoining the outer face of the drawer rear wall 17 and being fastened there by the fastener. In contrast, the base section 29 projects at right angles from the mounting web 30 and extends below the drawer rear wall 17 in the region underneath the drawer bottom 15.

Furthermore, the first functional element 23 has a movement section 32, which is hung in a manner allowing movement in relation to the base section 29. The movement section is also designed in the manner of a plate and is arranged at a distance opposite the base section 29.

As shown, in particular, in FIG. 13, the movement section 32 is suspended from the base section 29 by the bearing mechanism in a manner allowing a swiveling motion. The bearing mechanism comprises a hinge 33, which is effective between the base section 29 and the movement section 32. The hinge 33 is disposed in the region of one of the side edges of the drawer in such a way that on the side of the first functional element 23 that is opposite the hinge 33, an opening, which extends in the pull-out direction, is formed between the base section 29 and the movement section 32 of the first functional element 23. The hinge 33 comprises a hinge axis 34, which connects the two hinge-sided ends, which face each other, of the base section 29, on the one hand, and of the movement section 32, on the other hand. Said hinge axis prevents the freely hanging movement section 32 from disconnecting itself from the base section 29. The hinge side of the first functional element 23 forms a kind of book spine, as a result of which the movement section 32 can be swung out and away from the base section 29.

Furthermore, the hinge 33 has two hinge legs 35, which are arranged on the base section 29 on opposite transverse sides and which project away from the base section 29. These hinge legs plunge into corresponding hinge retainers 36, which are disposed on the two opposite transverse sides on the movement section 32 and which open in the direction of the base section 29. When the movement section 32 is swiveled about the hinge axis 34 in relation to the base section 29, the legs 35 move a little way out of the associated hinge retainers.

As shown, furthermore, in FIG. 13, there is at least one spring, in particular, a tension spring 37, between the base section 29 and the movement section 32 of the first functional element 23. This tension spring makes sure that the movement section 32 of the first functional element 23 snaps back into its starting position, when it is not engaged with the second functional element 24.

It is expedient for there to be two tension springs 37, of which the one is assigned to the transverse side and the other is assigned to the other transverse side of the first functional element 23. The tension springs 37 can be separate parts with respect to the base section 29 and the movement section 32. These tension springs can be fastened, on the one hand, to the base section 29 and, on the other hand, to the movement section 32 in such a way that they can be disconnected. For example, these tension springs can be clipped into retainers, which are provided for this purpose. It is possible that the tension springs 37 are made of the material of the first functional element 23, which is made of a synthetic plastic material. However, as an alternative, it is also possible to make the tension springs 37 of other materials, for example, a metal material.

As also shown in FIG. 13, the aforementioned clamping roller 25 is on board the first functional element 23, and, in particular, it is positioned there in a rotating manner on a pin-like roller bearing 38, which projects upwards from the top side of the movement section 32. The clamping roller 25 is made expediently of a rubber material.

As shown, in addition, in FIG. 13, there is a guide section 39 on the longitudinal side of the movement section 32 that faces away from the hinge. Said guide section comes to rest against the aforementioned control surface 60 of the second functional element 24 and is guided there. The guide section 39 has an external guide web 40, which forms a long-sided termination of the movement section 32. The guide web 40 is spaced apart from the clamping roller 25.

Figure 12:
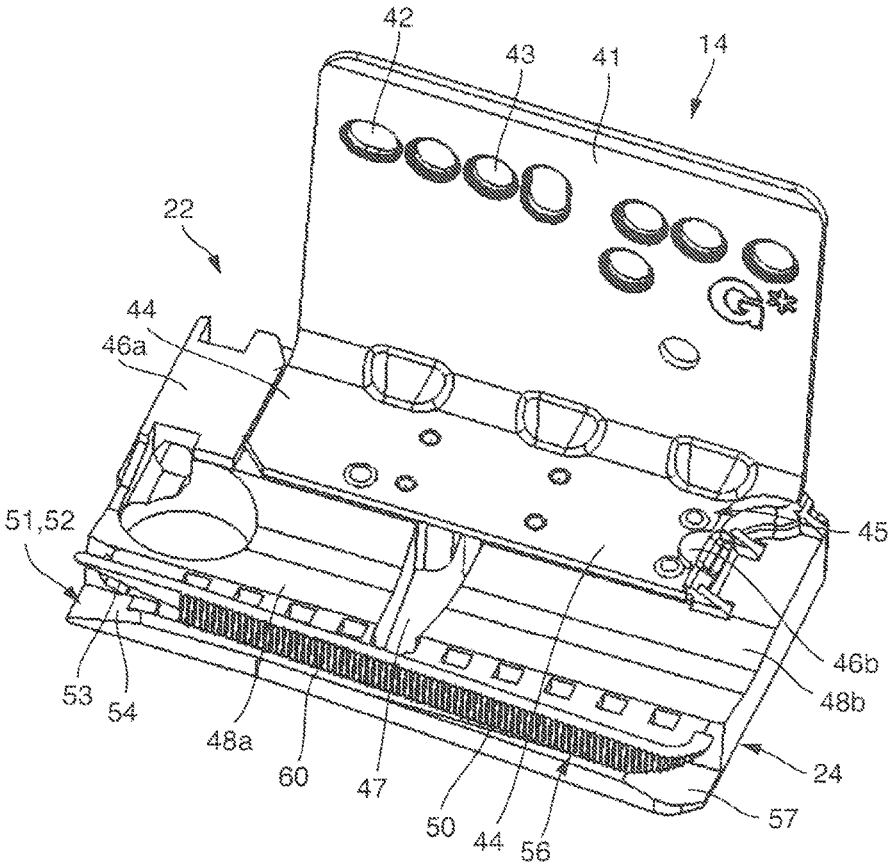
FIG. 12 a perspective representation of the body-sided second functional element mounted on an associated body-sided furniture component.

As shown in FIG. 12 as an example, the body-sided second functional element 24 is fastened to the body rail 14. For this purpose the body rail has a plurality of mounting angle brackets 41, which are arranged one after the other in succession in the longitudinal direction of the body rail 14. Of the mounting angle bracket 41, only one mounting angle bracket or, more specifically, the foremost mounting angle bracket is shown on the body rail in FIG. 12 merely for illustrative purposes. The mounting angle bracket 41 has a mounting leg 42, which has a plurality of fastening holes 43, which are arranged, for example, one after the other in rows. These fastening holes can be used to fasten the mounting angle bracket 41 via a suitable fastener, for example, screws, to an associated side wall of a drawer holder (not depicted), which is designed in the furniture body, in such a way that the mounting angle bracket is fixed in position.

As shown, in particular, in FIG. 1, the second functional element 24 extends below the drawer bottom 15 of the drawer.

The mounting angle bracket 41 has a functional leg 44, which projects at an angle, in particular, at right angles from the mounting leg 42 and to which the second functional element 24 can be fastened. The second body-sided functional element 24 is designed as a flat body, for example, in the form of a carrier plate. The second functional element 24, which can also be referred to as the accessory carrier, is made expediently of a synthetic plastic material.

On a top side 45 of the second functional element 24 there is a mounting interface 45 for mounting the second functional element 24 on the functional leg 44 of the mounting angle bracket 41. The mounting interface 45 has first and second holders 46*a*, 46*b*, which overlap the functional leg 44 of the mounting angle bracket 41 in the mounted state of the second functional element 24.

The second functional element 24 has a slot 47, which extends transversely to its longitudinal extent and which is open towards a longitudinal side of the second functional element 24.

The slot 47 divides the second functional element 24 into a first and a second carrier part 48*a*, 48*b*. The two carrier parts 48*a*, 48*b* can be moved relative to each other in such a way that the distance between the two holders 46*a*, 46*b* for mounting the second functional element 24 on the associated functional leg 44 can be enlarged with simultaneous widening of the slot 47. The two carrier parts 48*a*, 48*b* are connected together via a solid hinged joint 49 at the base of the slot 47 in such a way that they can be moved. In addition, the rear section is designed to be springy/resilient.

As also shown in FIG. 12, the second functional element 24 has a control element 50, which is designed in the manner of a web having a bottom side, on which the control surface 60 is formed.

Figure 6:
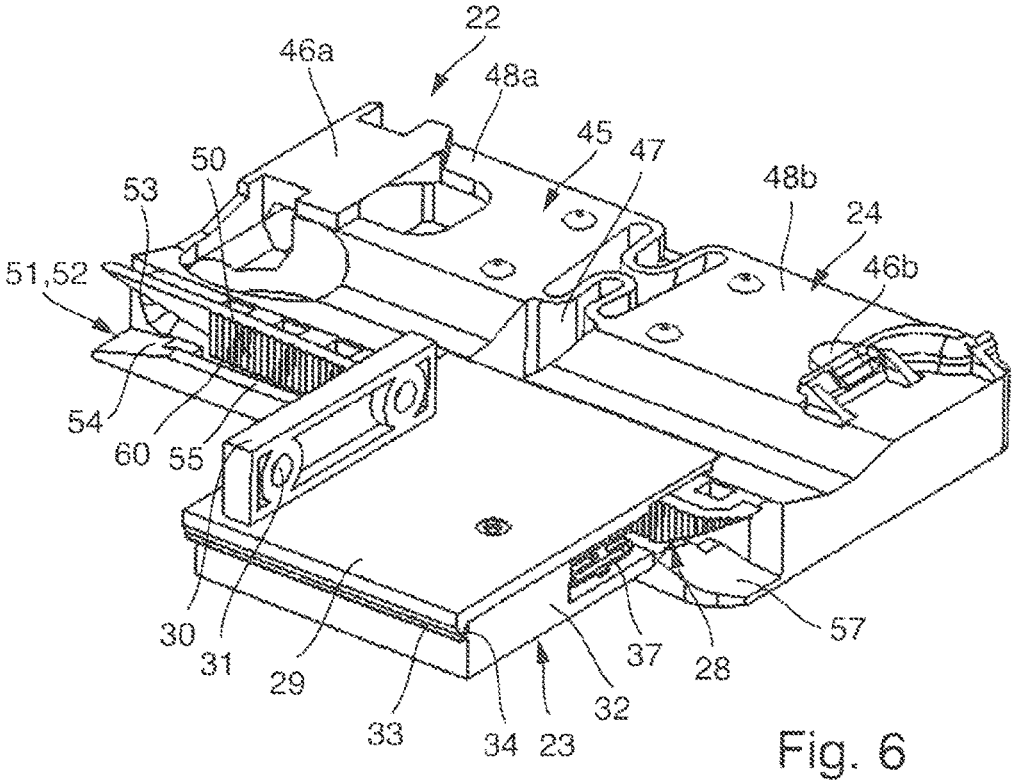
FIG. 6 an exploded perspective representation of the functional device from FIG. 4, with the pull-out-sided first functional element being guided on the body-sided second functional element.
Figure 7:
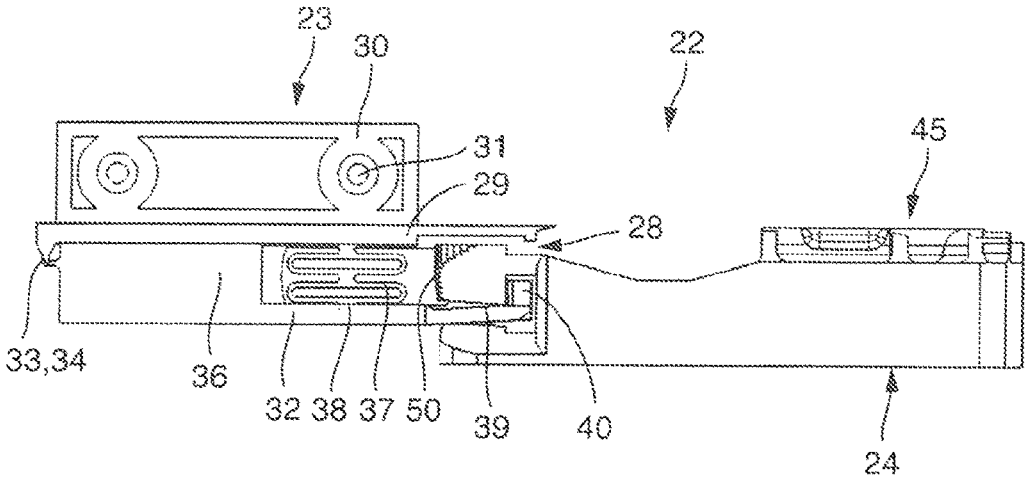
FIG. 7 a front view of the functional device from FIG. 6.
Figure 8:
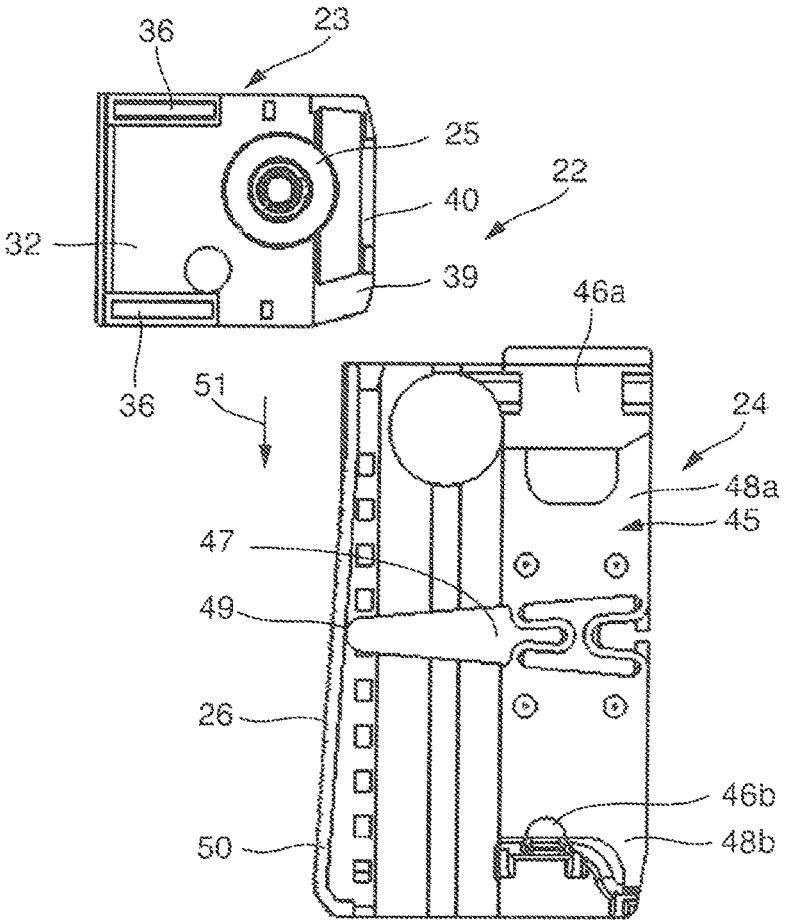
FIG. 8 a plan view of the functional device from FIG. 4, with the two functional elements disengaged.
Figure 9:
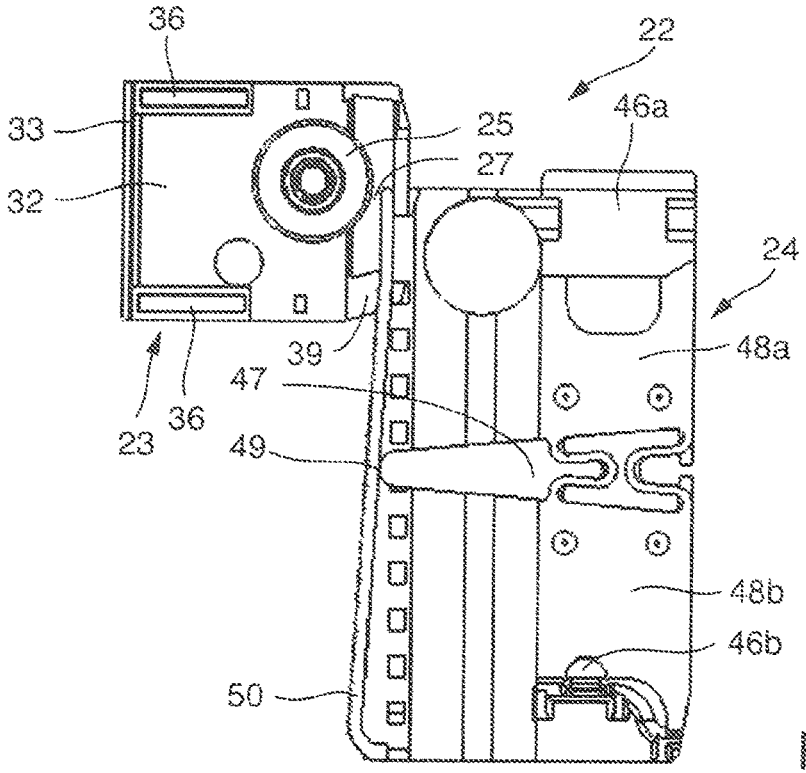
FIG. 9 a plan view of the functional device from FIG. 8, with the pull-out-sided first functional element engaged with the body-sided second functional element.
Figure 10:
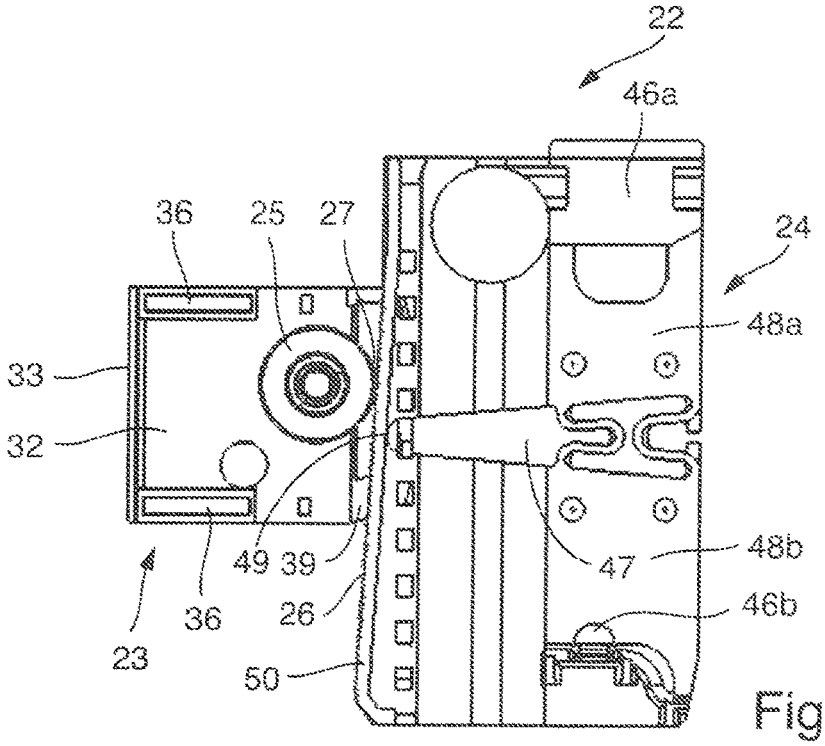
FIG. 10 a plan view of the functional device from FIG. 4, with the pull-out-sided first functional element being guided on the body-sided second functional element.
Figure 11:
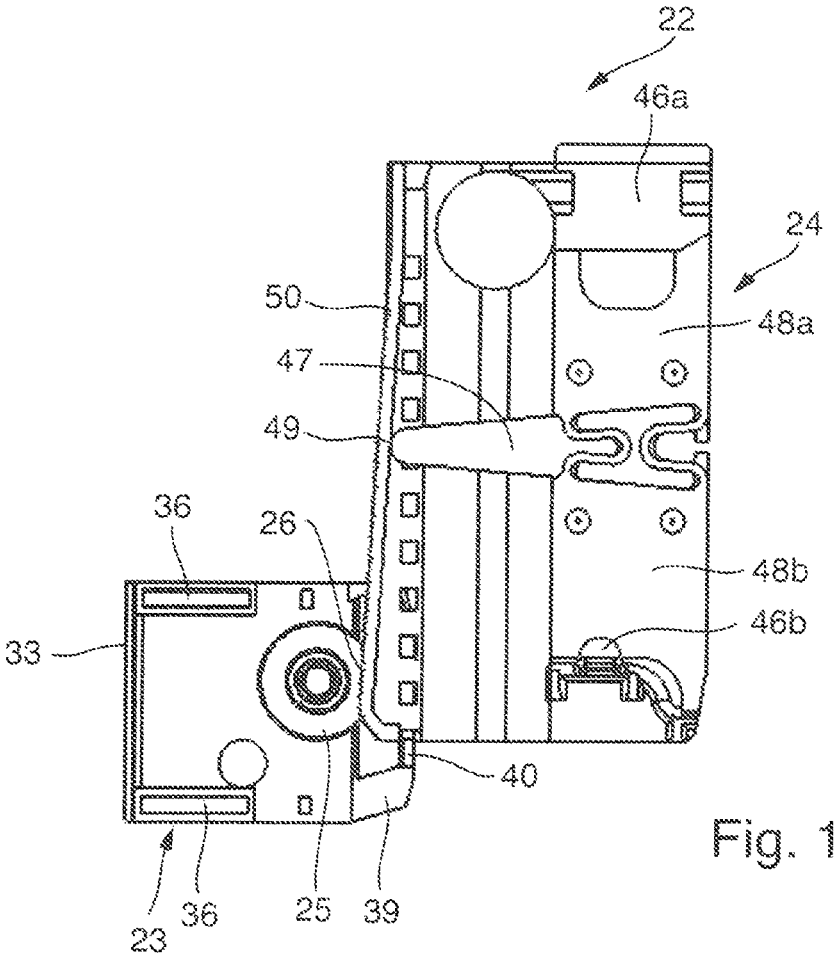
FIG. 11 a plan view of the functional device from FIG. 4, in the course of exercising the function of the functional device.

As shown, in particular, in FIG. 6 and also in FIG. 8, the web-like control element 50 extends on one of the longitudinal sides of the second functional element 24. However, at that location said control element does not extend parallel to the opposite longitudinal side, but rather protrudes outwardly into a direction of retraction 51 (FIG. 8) of the first functional element 23.

As shown, in particular, in FIG. 6, the control surface 60 at the control element 50 has a funnel-shaped retraction region 52, which is formed by an inclined section 53, which extends at an angle, on the control surface 60 and a corresponding inclined section 54 on a check surface 55, opposite the control surface 60.

Figure 4:
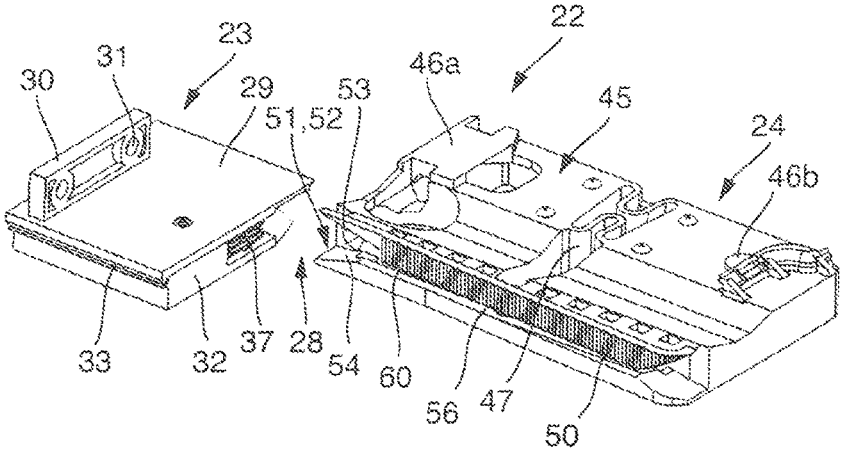
FIG. 4 a perspective representation of the functional device of the inventive guide device with the two functional elements disengaged.
Figure 5:
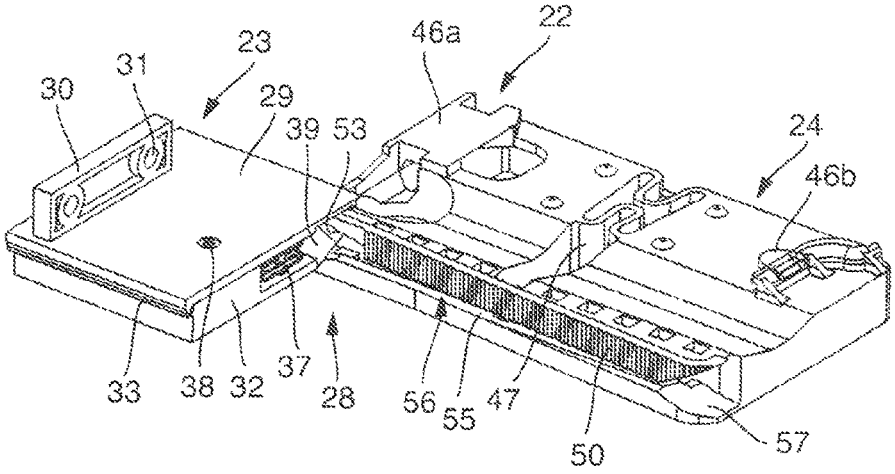
FIG. 5 a perspective representation of the functional device from FIG. 4, with the pull-out-sided first functional element engaged with the body-sided second functional element.

As shown, in particular, in FIGS. 4 and 5, the control surface 60 on the bottom side of the control element 50 and the opposite check surface 55 form a kind of guide channel 56, in order to guide the guide section 39 of the first functional element 23. Opposite the retraction region 52, the control surface 60 and the check surface 55 form an extension region 57, which is also in the shape of a funnel.

As shown, in particular, in FIG. 1, the drawer is initially in the closed position, shown in FIG. 1, i.e., completely retracted into the associated drawer holder. The two functional elements 23, 24 are far away from each other, because the second functional element 24 is in the region of the front panel 16 of the drawer, whereas the first functional element 23 is assigned to the drawer rear wall 17.

FIGS. 2 and 3 show the situation, in which the drawer is pulled out in the direction of its open position, immediately before the first functional element 23 comes into contact with the second functional element 24. As stated above, in order to damp the outward extension movement into the open position it is necessary that the clamping roller 25 comes into contact with the clamping wedge 26. If at this point a tilt adjustment of the drawer is carried out, as shown in schematic form in FIG. 3, by moving the front panel 16 downwards and correspondingly by moving the drawer rear wall 17 upwards, then there is the requirement that the functional device 22, which is designed as the damping device, must remain functionally effective even during this tilt adjustment. However, this function is guaranteed by means of the catch device 28 and the two functional elements 23, 24. Irrespective of the tilt of the drawer, the guide section 39 on the movement section 32 of the first functional element 23 enters into the funnel-like retraction region 52 on the first functional element 23, and the guide section 39 rests with its top side against the control surface 60 of the bottom side of the control element 50, as a result of which the first functional element 23 is then automatically guided by the control surface 60.

If the first functional element 23 is located further upwards in accordance with FIG. 3 as a result of the tilt adjustment, then the movement section 32 swings away from the base section 29, which is stationary in relation to the drawer, i.e., is swung away from the stationary base section 29 by means of the hinge 33. In any event the stroke of the movement section 32 is adjusted with respect to the base section 29 in such a way that said stroke is greater than the adjustment travel during the tilt adjustment, so that it is always guaranteed that the first functional element 23 enters into the guide channel 56 on the second functional element 24 and is guided at that location.

As the sequence of FIGS. 8 to 11 shows, during the retraction movement of the first functional element 23, the clamping roller 25, which is disposed on the movement section 32, comes into contact with the outer face of the control element 50, which forms the clamping wedge 26. When the first functional element 23 continues to move further into the guide channel 56, the clamping gap 27 decreases, so that the result is a clamping effect, which in turn causes the drawer to slow down. Since the web-like control element 50 is elastically resilient to some extent and since the clamping roller is also made of a rubber material, the braking process does not take place abruptly, but rather slowly.

Figure 14:
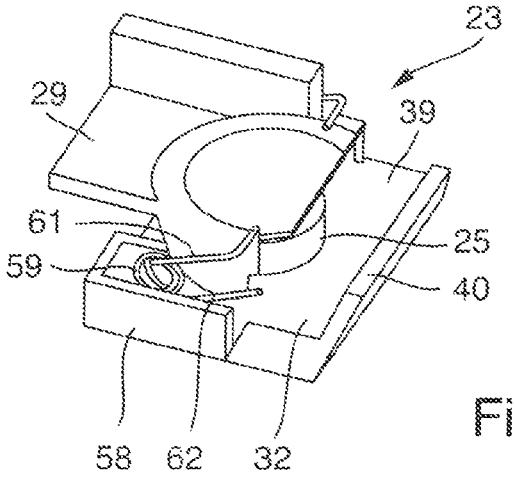

FIG. 14 shows a second exemplary embodiment of the inventive guide device 11, which differs from the above described first exemplary embodiment in that another embodiment of the first functional element 23 is used. In contrast to the above described first exemplary embodiment, the base section 29 and the movement section 32 of the first functional element 23 are not hung in a manner allowing a swiveling motion in relation to each other, but rather are hung in a manner allowing a linear motion in relation to each other.

As shown, in particular, in FIG. 14, there are two upwardly opened retainers 58 on the top side of the movement section 32 of the first functional element 23, and the respective leg springs 59 can be inserted into the said retainers and fastened there. On the other hand, the two leg springs 59, which are disposed on the opposite transverse sides of the second functional element 24, are fastened to the base section 29. Consequently the leg springs 59 have a first leg 61, which is assigned to the movement section 32, and a second leg 62, which is assigned to the base section 29, and these first and second legs can be spread far apart from each other. Therefore, during the inward retraction movement of the first functional element 23 in accordance with a tilt adjustment of the drawer shown in FIG. 3, the two legs 61, 62 spread apart, and the movement section 32 is moved linearly away from the base section 29, so that it can move into the retraction region 52 of the first functional element 23.

What is claimed is:

1. A guide device for guiding a furniture pull-out that is moveable in relation to a furniture body, the guide device comprising:

at least one guide unit comprising: a body rail capable of being fastened to the furniture body; and at least one running rail that is displaceably mounted relative to the body rail;

a functional device comprising:

at least a first functional element capable of being fastened to the moveable furniture pull-out;

at least one body-sided second functional element, both the first functional element and the second functional element being guided on one another during retraction movement and/or extension movement of the furniture pull-out; and a catch device including: a bearing mechanism configured to moveably hang the first or second functional element; and a control surface formed on the first and/or second functional element and configured to capture the first functional element to subsequently guide on the second functional element;

wherein the first functional element has a base section configured to be rigidly fastened to the furniture pull-out, and a movement section moveably hung in relation to the base section, the movement section being moveable between a starting position and functional positions that are farther away from the base section, wherein the bearing mechanism is configured to hang the movement section in a manner allowing a swiveling motion in relation to the base section, and wherein the bearing mechanism includes a hinge disposed between the base section and the movement section.

2. The guide device of claim 1, wherein the first functional element is configured to be moveably suspended from the furniture pull-out relative to the furniture pull-out via the bearing mechanism, and the second functional element is configure to be fastened stationarily relative to the furniture body by a mounting mechanism.

3. The guide device of claim 2, wherein the control surface is formed on the body-sided second functional element.

4. The guide device of claim 3, wherein the second functional element has a control element comprising a web having a bottom side on which the control surface is formed.

5. The guide device of claim 1, wherein the control surface has an inclined section that extends at an angle in relation to the direction of movement of the furniture pull-out.

6. The guide device of claim 1, wherein the body-sided second functional element includes a mounting interface for fastening, without a tool, to the furniture body or to a mounting angle bracket, which is configured to be fastened to the furniture body or to a mounting section of the body rail.

7. The guide device of claim 1, wherein the second functional element comprises a plate.

8. The guide device of claim 1, wherein the second functional element has a fastening interface for fastening accessory parts thereto.

9. The guide device of claim 1, wherein the bearing mechanism includes at least one spring element having a spring force that acts on the movement section in the direction of the starting position.

10. The guide device of claim 1, wherein the bearing mechanism is configured for a linearly moveable suspension of the movement section in relation to the base section.

11. The guide device of claim 1, wherein the functional device comprises a damping device to damp the opening movement of the moveable piece of furniture, the guide device further comprising: a clamping roller disposed on the first functional element; and a clamping wedge configured to interact with the clamping roller and disposed on the second functional element.

12. Furniture comprising:

at least one moveable piece of furniture comprising a drawer; and the guide device of claim 1.

* * * * *